US009289669B2

(12) United States Patent
Suk et al.

(10) Patent No.: US 9,289,669 B2
(45) Date of Patent: Mar. 22, 2016

(54) METHOD FOR MEASURING THE PHYSICAL QUANTITY OF AN OBJECT USING A SINGLE LIGHT SOURCE AND A FLAT SURFACE SENSOR UNIT, AND VIRTUAL GOLF SYSTEM USING THE METHOD

(76) Inventors: Jey Ho Suk, Seoul (KR); Yong Ho Suk, Sungnam-si (KR)

( * ) Notice: Subject to any disclaimer, the term of this patent is extended or adjusted under 35 U.S.C. 154(b) by 2 days.

(21) Appl. No.: 13/496,181

(22) PCT Filed: Sep. 15, 2010

(86) PCT No.: PCT/KR2010/006317

§ 371 (c)(1),
(2), (4) Date: Mar. 14, 2012

(87) PCT Pub. No.: WO2011/034343

PCT Pub. Date: Mar. 24, 2011

(65) Prior Publication Data

US 2012/0170058 A1 Jul. 5, 2012

(30) Foreign Application Priority Data

Sep. 15, 2009 (KR) ..... 10-2009-0087229

(51) Int. Cl.
*G01B 11/04* (2006.01)
*A63B 69/36* (2006.01)

(52) U.S. Cl.
CPC ..... *A63B 69/3623* (2013.01); *A63B 69/3614* (2013.01)

(58) Field of Classification Search
CPC ..... A63B 69/3623
USPC ..... 356/326
See application file for complete search history.

(56) References Cited

U.S. PATENT DOCUMENTS

| | | | | |
|---|---|---|---|---|
| 3,819,918 | A * | 6/1974 | Hale | 702/156 |
| 4,254,956 | A * | 3/1981 | Rusnak | 473/225 |
| 4,911,307 | A * | 3/1990 | Jennings | 209/586 |
| 5,333,874 | A * | 8/1994 | Arnold et al. | 473/156 |
| 5,437,457 | A | 8/1995 | Curchod | |
| 5,481,355 | A | 1/1996 | Iijima | |
| 6,302,802 | B1 | 10/2001 | Pao | |
| 2004/0185952 | A1 * | 9/2004 | Marshall | 473/151 |

FOREIGN PATENT DOCUMENTS

EP 1 749 555 A1 2/2007

* cited by examiner

*Primary Examiner* — Tarifur Chowdhury
*Assistant Examiner* — Omar Nixon

(57) ABSTRACT

A method for measuring a physical quantity of an object by using a single light source and a planar sensor unit, and a virtual golf system using the same are provided. According to one aspect of the present invention, there is provided a method for measuring a physical quantity of an object by using a single light source and a planar sensor unit, the method comprising: detecting, by the planar sensor unit, a shadow of the object generated by light emitted from the single light source, wherein the planar sensor unit is disposed on a bottom surface opposed to the single light source; and measuring a physical quantity of the object based on information regarding the shadow.

12 Claims, 8 Drawing Sheets

METHOD FOR MEASURING THE PHYSICAL QUANTITY OF AN OBJECT USING A SINGLE LIGHT SOURCE AND A FLAT SURFACE SENSOR UNIT, AND VIRTUAL GOLF SYSTEM USING THE METHOD

FIELD OF THE INVENTION

The present invention relates to a method for measuring a physical quantity of an object by using a single light source and planar sensor unit, and a virtual golf system using the same. More particularly, the present invention relates to a method for detecting a shadow of an object (e.g., a golf ball) by using a single light source and a planar sensor unit disposed on a bottom surface opposed to the single light source and measuring a physical quantity such as the height or the like of the object based on the detected shadow, and a virtual golf system using the same.

BACKGROUND OF THE INVENTION

The number of people who play golf is continuously on the increase. However, the reality is that those who want to play golf cannot always go out on a golf course, so a virtual golf system (or a screen golf system) allowing people to virtually play gold at low costs even in downtown areas or the like is widely spreading. This virtual golf system is basically based on a concept that when a golfer hits a golf ball toward a screen, the virtual golf system detects a movement of the golf ball and virtually displays on a screen the results of hitting the golf ball obtained through a certain simulation process. In this virtual golf system, it is important that the height of the golf ball, a movement speed, a movement direction, and the like is measured to make a simulation to allow the golfer to feel the movement of the golf ball as he/she is actually playing on a golf course.

To this end, in most of the conventional virtual golf systems, information regarding a movement of the hit golf hole is collected and calculated by using a high-priced optical device such as a high speed camera or the like, but this method requires a considerably complicated technique and, most of all, it incurs a great amount of cost in implementing the virtual golf system.

Also, Japanese Patent Laid-Open Publication No. 2003-230767, U.S. Pat. No. 5,390,927, Japanese Patent No. 3394978, and the like disclose prior arts of detecting a movement of a golf ball by using a plurality of horizontal sensors and a plurality of vertical sensors, but the use of such prior arts still has a problem in terms of the complexity, implementation costs, or the like of the virtual golf system.

SUMMARY OF THE INVENTION

It is, therefore, an object of the present invention to solve all of the above-described problems of the prior arts.

Another object of the present invention is to precisely measure a physical quantity of an object by using only a single light source and a planar sensor unit.

Still another object of the present invention is to implement a virtual golf system effectively operated at a low cost.

Representative configurations of the present invention to accomplish the above objects are as follows.

According to one aspect of the present invention, there is provided a method for measuring a physical quantity of an object by using a single light source and a planar sensor unit, the method comprising: detecting, by the planar sensor unit, a shadow of the object generated by light emitted from the single light source, wherein the planar sensor unit is disposed on a bottom surface opposed to the single light source; and measuring a physical quantity of the object based on information regarding the shadow.

According to another aspect of the present invention, there is provided a system for measuring a physical quantity of an object, the system comprising: a single light source; a planar sensor unit for detecting a shadow of the object generated by light emitted from the single light source, wherein the planar sensor unit is disposed on a bottom surface opposed to the single light source; and a measurement device for measuring a physical quantity of the object based on information regarding the shadow.

BRIEF DESCRIPTION OF THE DRAWINGS

The above and other objects and features of the present invention will become apparent from the following description of embodiments, given in conjunction with the accompanying drawings, in which.

DETAILED DESCRIPTION OF THE EMBODIMENTS

Figure 1:
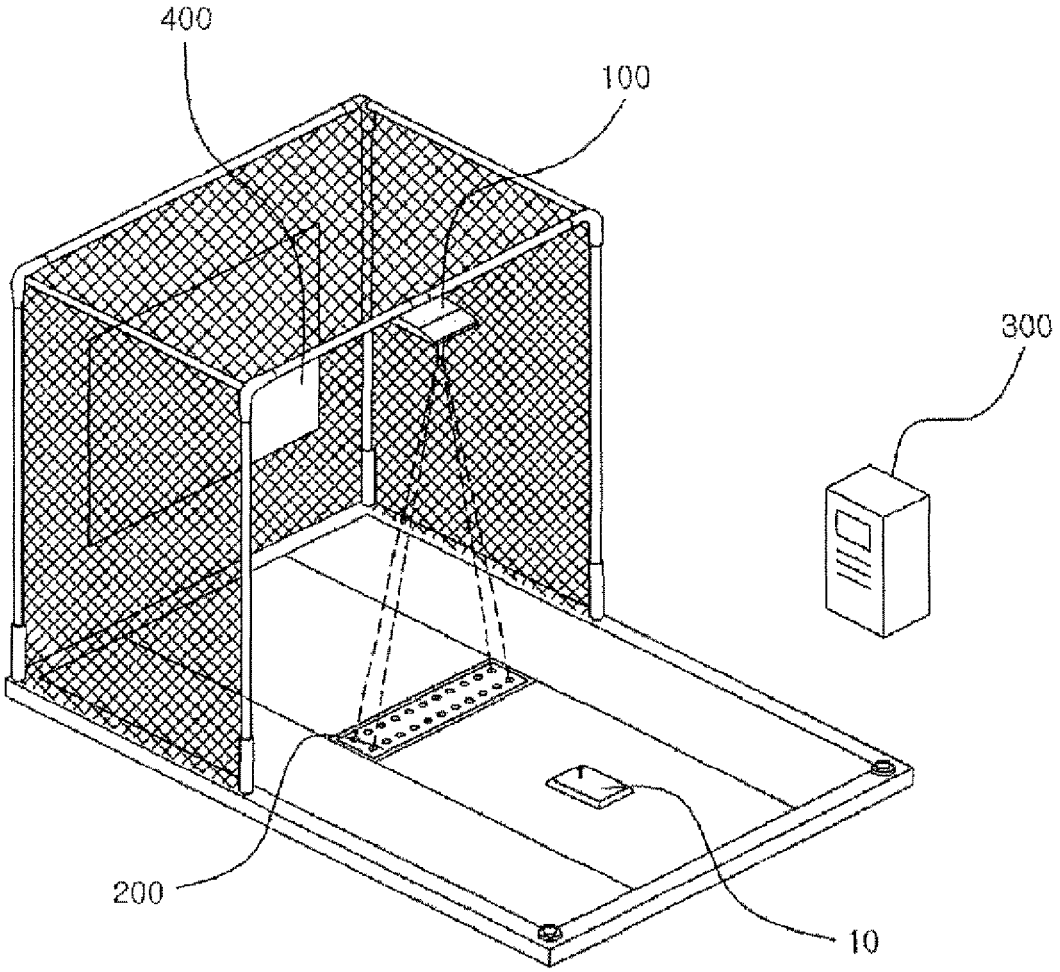
FIG. 1 is a view schematically showing a configuration of an overall system according to an embodiment of the present invention.

In the following detailed description, reference is made to the accompanying drawings that show, by way of illustration, specific embodiments in which the invention may be practiced. These embodiments are described in sufficient detail to enable those skilled in the art to practice the invention. It is to be understood that the various embodiments of the invention, although different from one another, are not necessarily mutually exclusive. For example, a particular feature, structure, and characteristic described herein in connection with one embodiment may be implemented within other embodiments without departing from the spirit and scope of the present invention. Also, it is to be understood that the positions or arrangements of individual elements in the embodiment may be changed without separating the spirit and scope of the present invention. The following detailed description is, therefore, not to be taken in a limiting sense, and the scope of the invention is defined only by the appended claims that should be appropriately interpreted along with the full range of equivalents to which the claims are entitled. In the drawings, like reference numerals identify identical or like or functions throughout the several views.

Hereinafter, preferred embodiments of the present invention will be described in detail with reference to the accompanying drawings so that those skilled in the art to which the invention pertains can easily carry out the present invention.

In the present disclosure hereinafter, a virtual golf system is mainly taken as an example of a system implemented to measure a physical quantity of an object by using a single light source and a planar sensor unit according to the present invention, but the present invention is not limited thereto and it should be understood that various measurement methods and systems for measuring a physical quantity of an object are all within the scope of the present invention so long as they are derived by the technical concept of the present invention.

Configuration of Overall System

FIG. 1 is a view schematically showing a configuration of an overall system according to an embodiment of the present invention. This overall system may be a virtual golf system.

Referring to FIG. 1, the overall system according to an embodiment of the present invention may be configured to include a starting unit 10 (a hitting unit 10 in case of a virtual golf system), a light source 100, a planar sensor unit 200, a measurement unit 300, and a display device 400.

First, the light source 100 according to an embodiment of the present invention may include a luminous body (preferably, one luminous body). The light source 100 may emit light to generate a shadow of an object positioned on a path of the light. In the present invention, straightness of light is used, so a laser light source or the like having excellent straightness is preferably used as the light source 100, but the present invention is not limited thereto and it is obvious that the light source 100 according to the present invention may be configured to freely include a known luminous body capable of generating a shadow of an object.

Next, the planar sensor unit 200 according to an embodiment of the present invention may be disposed on the bottom surface opposed to the light source 100. The planar sensor unit 200 may include a plurality of sensors (optical sensors), in which each of the sensors may serve to detect a shadow of an object.

Namely, the planar sensor unit 200 may detect a shadow generated when an object starting from the starting unit 10 (e.g., a golf ball hit at the hitting unit 10) passes between the light source 100 and the planar sensor unit 200. This will be further discussed through the following detailed description taken with reference to FIG. 2.

Next, the measurement device 300 according to an embodiment of the present invention may serve to calculate the height, movement speed, movement direction, or the like, of the shadow based on the information regarding the shadow detected by the planar sensor unit 200 (i.e., the size of the shadow, the duration in which the shadow passes over the sensor, the angle formed by the trace of the shadow, and the like). Also, the measurement device 300 may serve to display the simulation results regarding the movement of the object through the display unit 400.

This measurement device 300 may be a digital device having a capability of communicating with the planar sensor unit 200 and the display device 400, in which the digital device may include a dedicated processor for a virtual golf system. The dedicated processor may include a memory unit and have a numerical operation capability and a graphics processing capability.

The configuration of such measurement device 300 will be further described later with reference to FIG. 5.

Finally, the display device 400 according to an embodiment of the present invention is a device for displaying the results of numerical operations or graphics processing, and it may be a device for performing a function of displaying a certain image through a certain display unit. Preferably, the display device 400 may be composed of a screen that absorbs impact from the object such as a hit golf ball or the like and does not directly emit light, and a projector that outputs an image to the screen.

Configuration of Planar Sensor Unit

Hereinafter, an internal configuration of the planar sensor unit 200 according to an embodiment of the present invention and the function of each component will be described.

Figure 2:
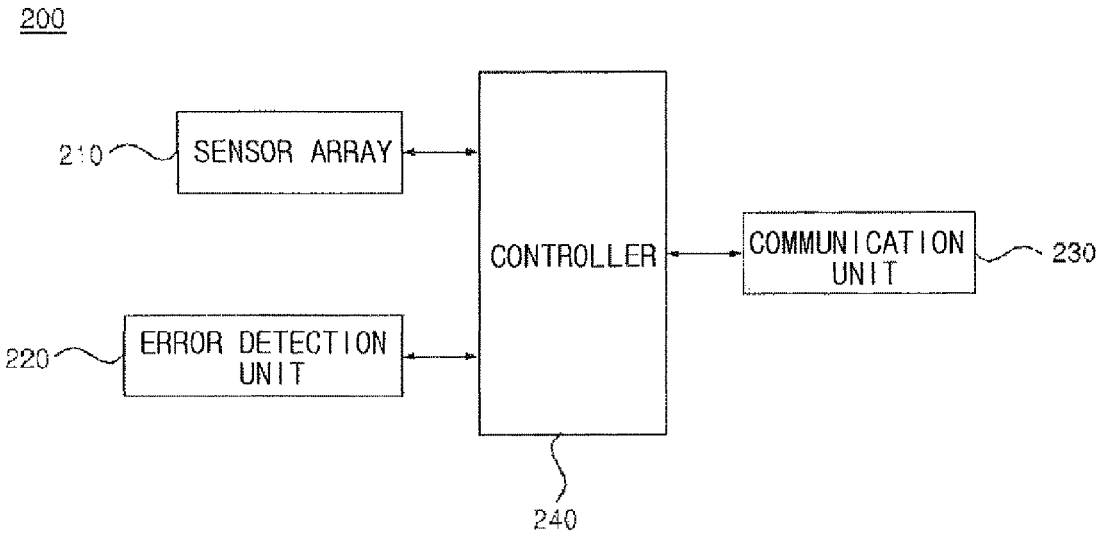
FIG. 2 is a detailed view showing an internal configuration of a planar sensor unit 200 according to an embodiment of the present invention.

FIG. 2 is a detailed view showing an internal configuration of the planar sensor unit 200 according to an embodiment of the present invention.

Referring to FIG. 2, the planar sensor unit 200 according to an embodiment of the present invention may include a sensor array 210, an error detection unit 220, a communication unit 230, and a controller 240.

According to an embodiment of the present invention, at least some of the sensor array 210, the error detection unit 220, the communication unit 230, and the controller 240 may be program modules communicating with the measurement device 300. These program modules may be incorporated into the planar sensor unit 200 in the form of an operating system, an application program module, and other program modules, and physically stored in any known memory device. Also, the program modules may be stored in a remote memory device that is able to communicate with the planar sensor unit 200. Meanwhile, the program modules may cover a routine, a sub-routine, a program, an object, a component, a data structure, and the like for performing a particular operation or executing a particular abstract data type which will be described later according to the present invention, but the present invention is not limited thereto.

First, the sensor array 210 according to an embodiment of the present invention may perform a function of detecting a shadow. Preferably, the sensor array 210 may include a plurality of optical sensors. More preferably, the sensor array 210 may include a sensor line in which a plurality of sensors are regularly arranged, and this will be further described later with reference to FIGS. 3 and 4.

Next, the error detection unit 220 according to an embodiment of the present invention may perform a function of detecting and correcting errors. This is because severe malfunction would occur if any one of the plurality of sensors used in the process of detecting a shadow has an error. This will be described in more detail later.

And then, the communication unit 230 according to an embodiment of the present invention may perform a function of transmitting the information regarding the shadow detected by the sensor array 210 to the measurement device 300. Overall, the communication unit 230 may perform a function of allowing the planar sensor unit 200 to communicate with an external device such as the measurement device 300, in which wired communication schemes such as Ethernet communication, USB communication, IEEE 1394 communication, serial communication, and parallel communication, and more preferably, wireless communication schemes such as infrared communication, Bluetooth communication, RF communication, and wireless LAN communication may be used for the communication without limitation.

Finally, the controller 240 according to an embodiment of the present invention may perform a function of controlling a data flow between the sensor array 210, the error detection unit 220, and the communication unit 230. Namely, the controller 240 may control a data flow from the outside or between the respective components of the planar sensor unit 200, thereby controlling the sensor array 210, the error detection unit 220, and the communication unit 230 to perform their specific functions, respectively.

Now, the internal configuration of the sensor array 210 and functions of the respective components according to an embodiment of the present invention will be described.

In order to precisely measure the height, movement speed, movement direction, or the like of an object by using the shadow generated by the object, the space between the sensors belonging to the sensor array 210 is preferably small. This is because, as the space therebetween is reduced, resolving power is increased to reduce measurement errors. However, if the respective sensors in a sensor line of the sensor array 210 are disposed to oppose the respective sensors in the opposite sensor line only one by one, it would be difficult for the space between the sensor lines to be smaller than the diameter of the sensor, so the configuration of the sensor array 210 may be optimized as follows.

Figure 3:
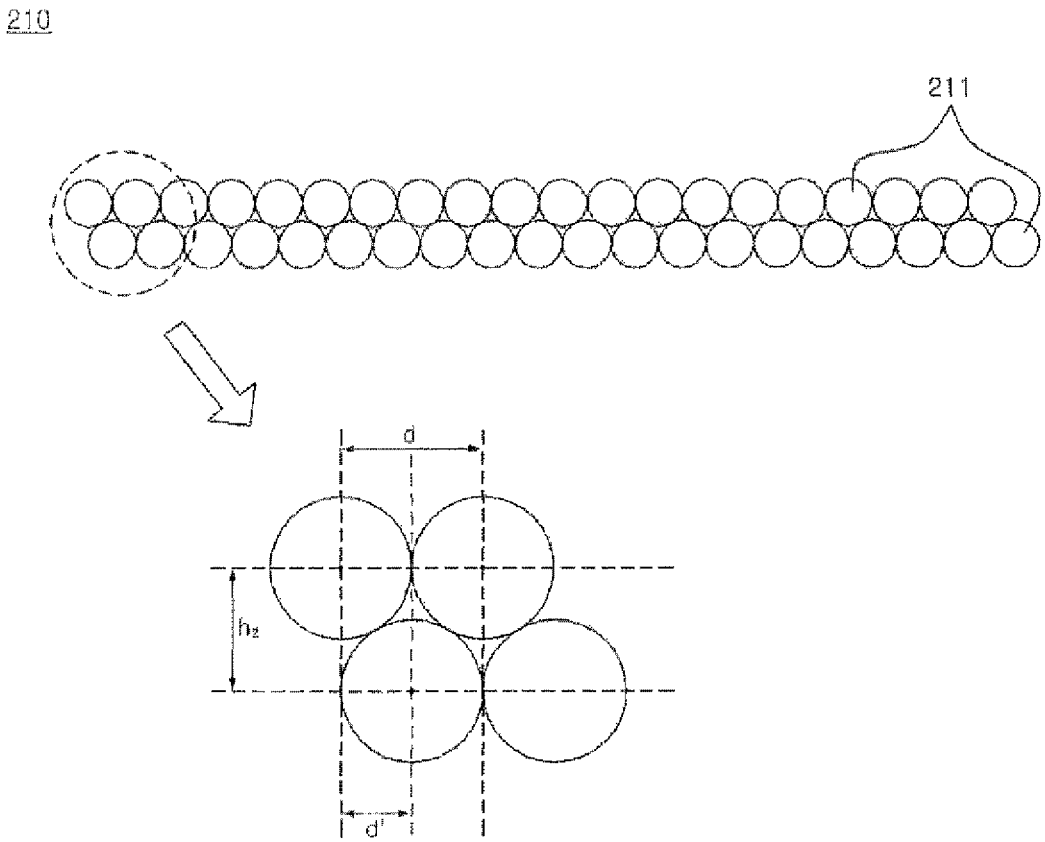
FIGS. 3 and 4 are views showing a configuration of a sensor array 210 according to an embodiment of the present invention.
Figure 4:
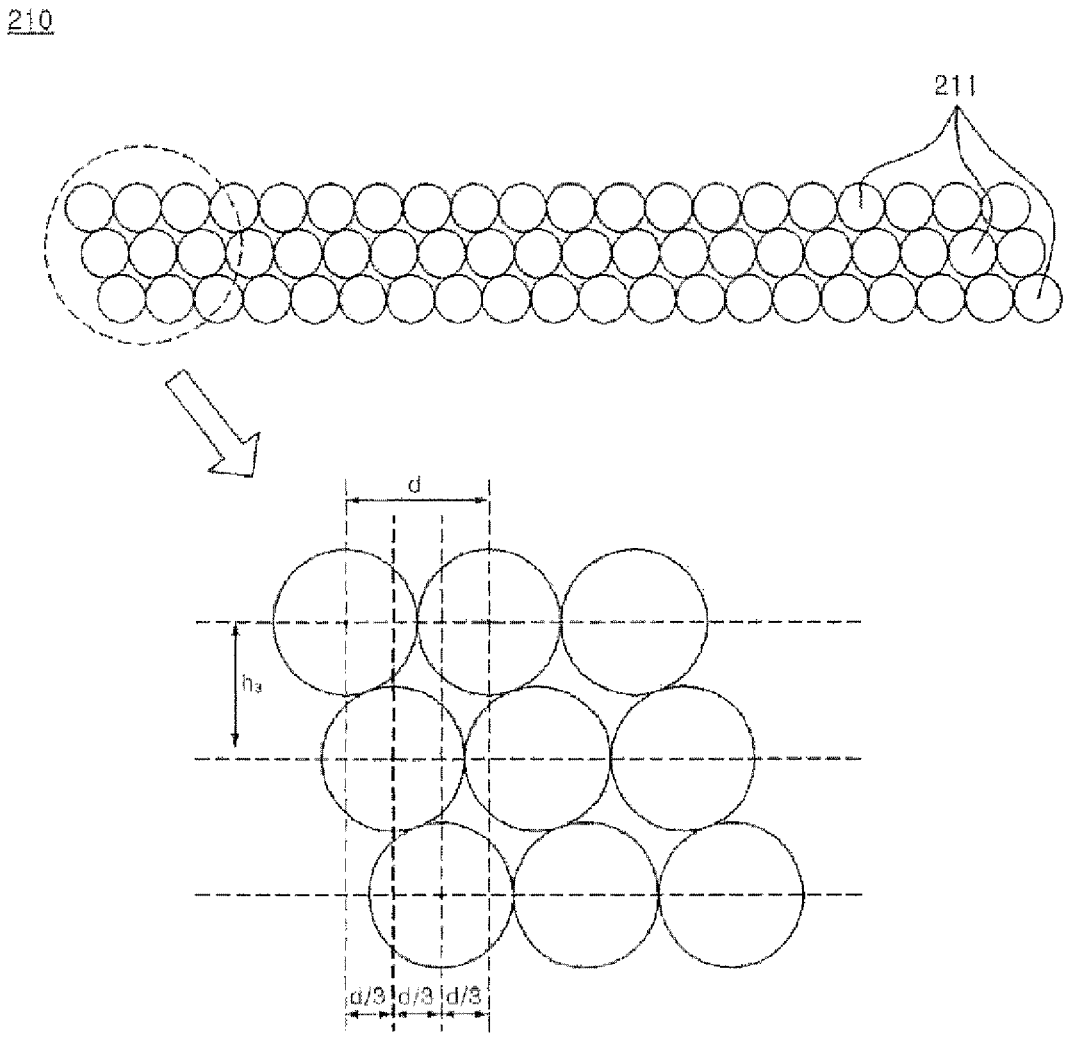

FIGS. 3 and 4 are views showing a configuration of the sensor array 210 according to an embodiment of the present invention.

Referring to FIGS. 3 and 4, the sensor array 210 according to an embodiment of the present invention may have a plurality of sensor lines including a plurality of sensors 211. Here, the number of the sensor lines may be two or greater. In case the sensor lines are disposed as shown in FIGS. 3 and 4, when the number of the sensor lines is n (where n is a natural number of two or greater), the space $h_n$ between the sensor lines satisfies Eq. (1) as shown below:

$$h_n = \frac{\sqrt{n^2 - 1}}{n} \times d \qquad \text{Eq. (1)}$$

In Eq. (1), d is a unit space between the sensors 211, and a minimum value thereof may be equal to the diameter of the sensor 211, and a maximum value thereof may be greater than the diameter of the sensor 211. As shown in FIGS. 3 and 4, a horizontal distance d' between the opposite sensors 211 in the two sensor lines may be represented as (1/n)×d.

With such a configuration, the resolving power of the sensor array 210 according to an embodiment of the present invention can be increased.

The function of the error detection unit 220 according to an embodiment of the present invention will now be described.

In general, error types that may occur in the sensors 211 are as follows.

(i) Error type 1: In spite of the absence of a shadow of an object, it is erroneously detected that there is a shadow. This is generally called a stuck-at-1 error.

(ii) Error type 2: In spite of the presence of a shadow of an object, it is erroneously detected that there is no shadow. This is generally called a stuck-at-0 error.

(iii) Error type 3: Information regarding a shadow is repeatedly output over time meaninglessly regardless of the presence or absence of a shadow of an object.

In the present invention, a reference value $V_{REF}$ of a sensor voltage may be used in order to solve such errors.

First, an initial value of $V_{REF}$ of a certain sensor 211 may be set to a sensor voltage $V_{MAX}$ when light is made incident to the sensor 211 without a shadow. At this time, a digital output value S of the sensor 211 is 0 (which means that there is no shadow). In this case, if the output value of the sensor 211 is erroneously 1, $V_{REF}$ must be reduced by a certain value. This reducing of $V_{REF}$ may be performed recursively.

If the $V_{REF}$ so determined is smaller than a minimum voltage $V_{TH,min}$ which has been recognized through an experiment or the like in advance and is allowed for the sensor, the corresponding sensor 211 may be subject to Error type 1. Also, if the determined $V_{REF}$ is greater than a maximum voltage $V_{TH,max}$ allowed for the sensor, the corresponding sensor 211 may be subject to Error type 2.

Further, after $V_{REF}$ is repeatedly measured several times in case light is made incident without a shadow, if the deviation of the repeatedly measured $V_{REF}$ is greater than a deviation value $V_{TH,vary}$ allowed for the sensor, the corresponding sensor 211 may be subject to Error type 3.

In the above, $V_{TH,min}$, $V_{TH,max}$, and $V_{TH,vary}$ may be values preset with reference to experimental conditions or sensor characteristics. In order to precisely determine $V_{TH,min}$, $V_{TH,max}$, and $V_{TH,vary}$, statistical data may be accumulated by using a large number of sensors.

When it is determined that any one of the plurality of sensors 211 belonging to the sensor array 210 has a type of error among the foregoing types, an output value of the corresponding sensor 211 is disregarded and it may be corrected by a proper output value based on an output value of a different sensor 211 adjacent to the corresponding sensor 211.

Details are as follows.

First, in case sensors 211 at both sides of the sensor 211 having an error are all normal and the output values of the both sensors 211 are equal, an output value of the sensor 211 having an error may be determined to be the same as the output values of the both sensors 211.

When the sensors 211 at both sides of the sensor 211 having an error are all normal and output values thereof are different, the sensor 211 having the error may maintain an output value at an immediately previous timing as its output value.

Of course, even when two or more sensors 211 have errors, error correction may also be performed according to the same logic.

Configuration of Measurement Device

Hereinafter, an internal configuration of the measurement device 300 and functions of each component according to an embodiment of the present invention will be described.

Figure 5:
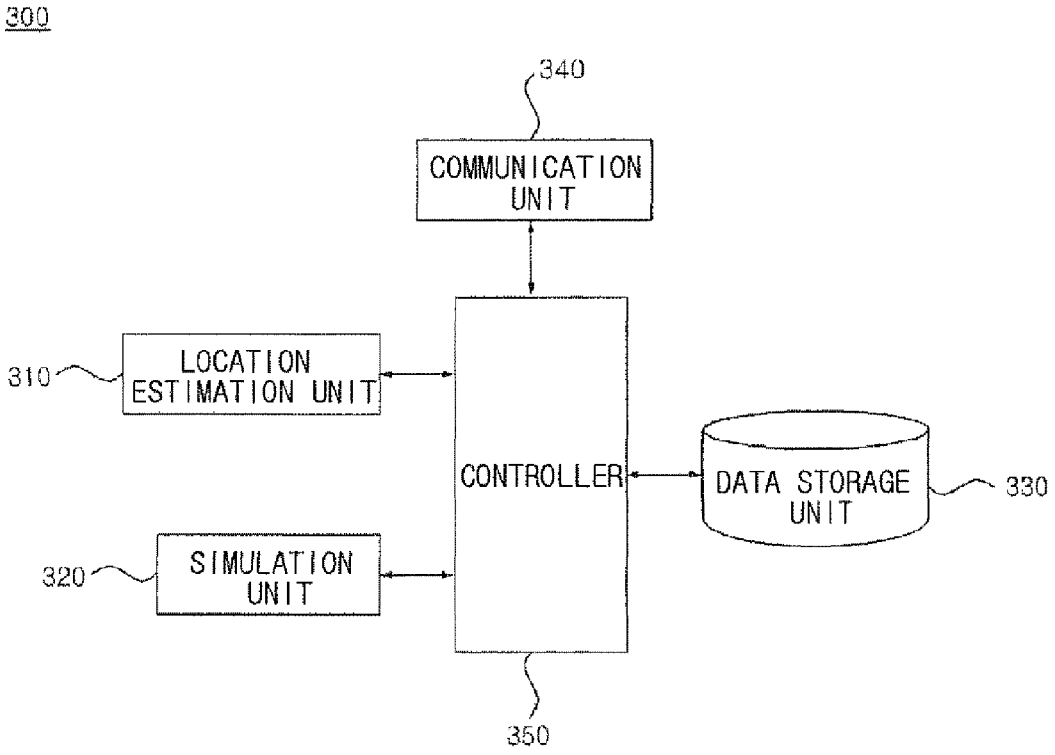
FIG. 5 is a detailed view showing an internal configuration of a measurement device 300 according to an embodiment of the present invention.

FIG. 5 is a detailed view showing an internal structure of the measurement device 300 according to an embodiment of the present invention.

Referring to FIG. 5, the measurement device 300 according to an embodiment of the present invention may be configured to include a measurement unit 310, a simulation unit 320, a data storage unit 330, a communication unit 340, and a controller 350.

According to an embodiment of the present invention, at least some of the measurement unit 310, the simulation unit 320, the data storage unit 330, the communication unit 340, and the controller 350 may be program modules communicating with the planar sensor unit 200 and/or the display device 400. The program modules may be incorporated into the planar sensor unit 200 in the form of an operating system, an application program module, and other program modules, and physically stored in any known memory device. Also, the program modules may be stored in a remote memory device that is able to communicate with the planar sensor unit 200. Meanwhile, the program modules may cover a routine, a sub-routine, a program, an object, a component, a data structure, and the like for performing a particular operation or executing a particular abstract data type which will be described later according to the present invention, but the present invention is not limited thereto.

First, the measurement unit 310 according to an embodiment of the present invention may perform a function of measuring a physical quantity of an object based on information regarding a shadow detected by the planar sensor unit 200.

More specifically, first, the measurement unit 310 may measure a height of an object based on the number of sensors 211 over which the shadow generated by the object passes.

Or, the measurement unit 310 may also obtain the sum of duration in which the shadow generated by an object passes over the plurality of sensors 211 and then remove a variation caused by the movement speed of the object from the sum to measure the height of the object from the resultant value.

Or, the measurement unit 310 may measure the height of the object based on a duration in which the shadow generated by the object passes over the sensors 211 and an angle between a straight line connecting the light source 100 and the sensors 211 and a trace of the object.

The method for measuring the height by the measurement unit 310 according to various embodiments as described above will be described in more detail later with reference to FIGS. 6 to 8.

Next, the simulation unit 320 according to an embodiment of the present invention may perform a function of expressing a movement of an object by reflecting it in a graphics object based on information regarding the measured physical quantity such as the height or the like of the object. Also, the simulation unit 320 may transmit a control signal including an image signal to the display device 400 so that the movement of the object can be expressed realistically.

Further, the data storage unit 330 according to an embodiment of the present invention may store information regarding the shadow or simulation information. The data storage unit 330 may include a computer-readable recording medium.

Next, the communication unit 340 according to an embodiment of the present invention may serve to receive the information regarding the shadow from the planar sensor unit 200 and transmit the simulation information to the display device 400. Overall, the communication unit 340 may perform a function of allowing the measurement device 300 to communicate with an external device such as the planar sensor unit 200 or the display device 400, in which wired communication schemes such as Ethernet communication, USB communication, IEEE 1394 communication, serial communication, and parallel communication, and more preferably, wireless communication schemes such as infrared communication, Bluetooth communication, RF communication, and wireless LAN communication may be used for the communication without limitation.

Finally, the controller 350 according to an embodiment of the present invention may perform a function of controlling a data flow between the measurement unit 310, the simulation unit 320, the data storage unit 330, and the communication unit 340. Namely, the controller 350 may control a data flow from the outside or between the respective components of the measurement device 300, thereby controlling the measurement unit 310, the simulation unit 320, the data storage unit 330, and the communication unit 340 to perform their specific functions, respectively.

Measurement of Height of Object

Figure 6:
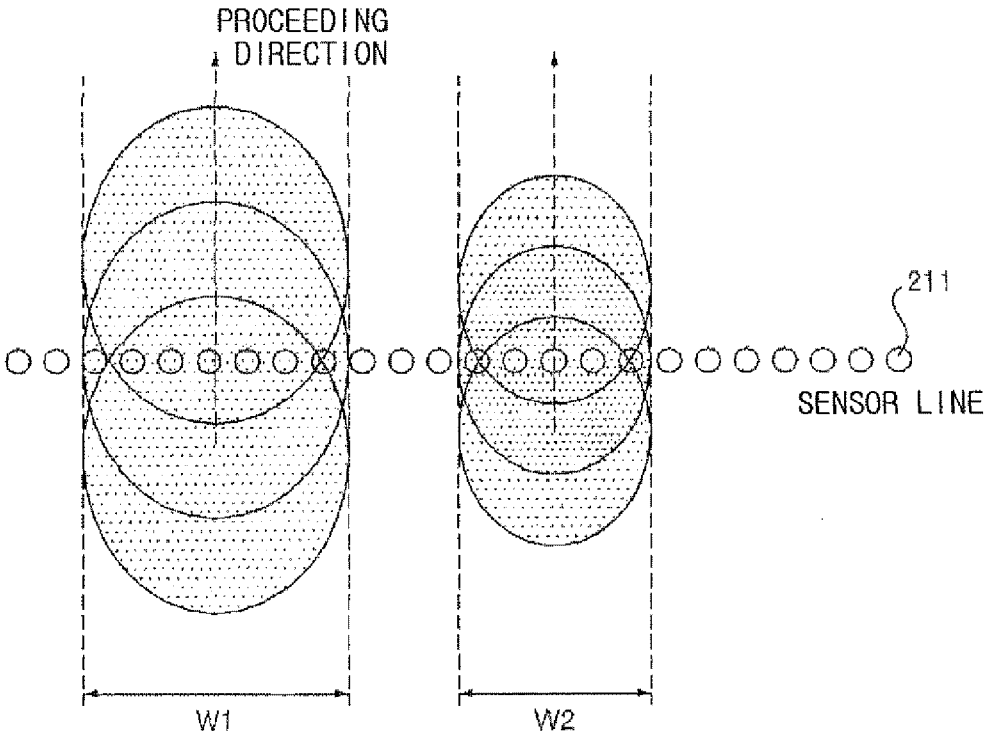
FIGS. 6 and 7 are conceptual views regarding an idea of measuring the height of an object based on the size of a shadow according to an embodiment of the present invention.
Figure 7:
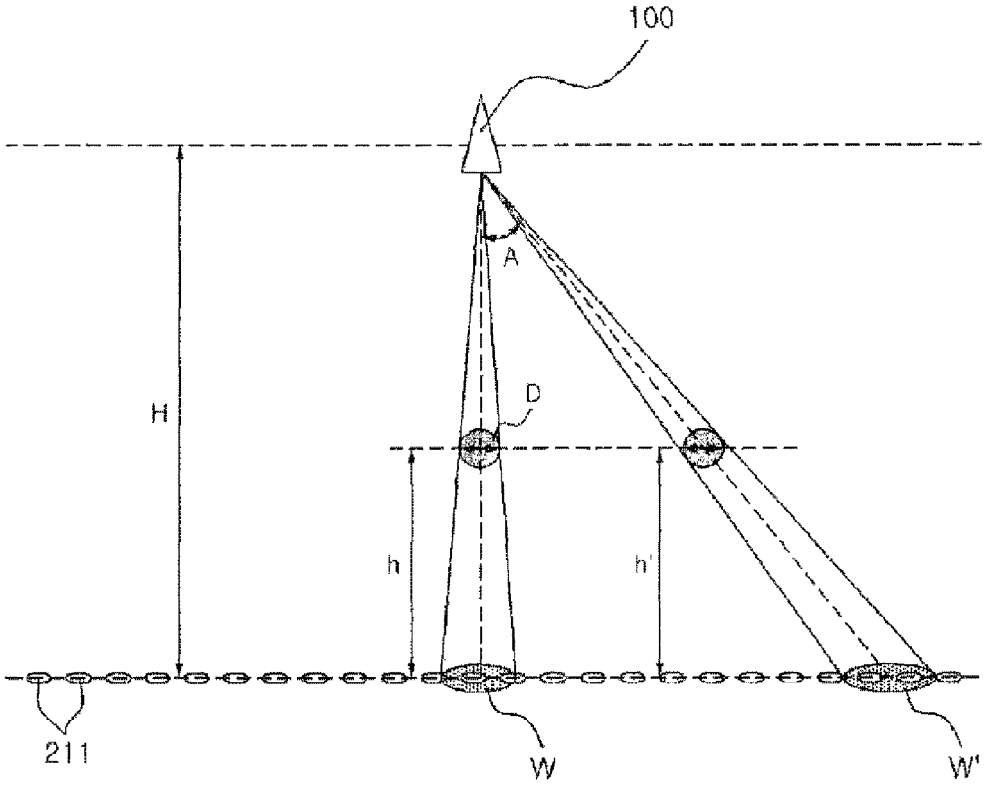

FIGS. 6 and 7 are conceptual views regarding an idea of measuring the height of an object based on the size of a shadow according to an embodiment of the present invention.

(1) Idea of measuring the height of the object based on the number of sensors over which the shadow passes First, as shown in FIG. 6, the planar sensor unit 200 according to an embodiment of the present invention may detect the position and number of the sensors 211 over which shadow 1 and shadow 2 pass. Here, the width of shadow 1 is W1 and that of shadow 2 may be W2.

As illustrated, it may be determined that W1 is a width corresponding to seven sensors 211 and W2 is a width corresponding to five sensors 211. According to the present invention, the space between the respective sensors 211 is known information, so the size of the shadow may be measured based on the number of the sensors 211 from which the shadows are detected.

Most simply, when the object passes over immediately under between the light source 100 and the bottom surface (as shown in the left side of FIG. 7), the height h of the object may be expressed by Eq. (2):

$$h = \left(1 - \frac{D}{W}\right) \times H \qquad \text{Eq. (2)}$$

wherein W is the size (diameter) of the shadow, D is the size (diameter) of the object, and H is the shortest distance between the light source 100 and the planar sensor unit 200. According to the present invention, values of D and H may be predetermined values.

Meanwhile, when the object makes an angle A with a perpendicular between the light source 100 and the bottom surface with reference to the position of the light source 100 (as shown in the right side of FIG. 7), the height h' of the object may be expressed by Eq. (3):

$$h' = \left(1 - \frac{D}{W'}\right) \times H \times \mathrm{COS}^2 A \qquad \text{Eq. (3)}$$

wherein cos A may be easily obtained by using H and the distance between the light source 100 and the sensors 211 over which the shadow passes.

(2) Idea of obtaining the sum of duration in which a shadow passes over a plurality of sensors and then removing a variation caused by the movement speed of an object from the sum to measure the height of the object from the resultant value The duration of movement of the shadow passing over the sensors 211 may be determined by the size of the shadow and the movement speed of the shadow (i.e., the movement speed of the object). Accordingly, the following amount can be defined.

$$S = \sum_{i=p}^{q} s_i \times t_i \qquad \text{Eq. (4)}$$

wherein p is an index of the first sensor 211 over which the shadow passes, q is an index of the last sensor 211 over which the shadow passes, $s_i(s_i)$ is an output strength of an $i^{th}$ sensor 211 over which the shadow passes, $t_i(t_i)$ is a duration in which the shadow passes over the $i^{th}$ sensor 211, and S is a weighted sum of the output strength of the sensor 211 over which the shadow passes and the duration in which the shadow passes over the sensor 211.

When this value is divided by a duration in which the shadow passes over the sensor lines and normalized, an estimate value A of the size of the shadow can be obtained as shown in Eq. (5):

$$A = \frac{S}{T} \quad \text{Eq. (5)}$$

wherein T is a duration in which the shadow passes over the sensor line. When the size of the shadow is estimated according to the foregoing method, the height of the object can be obtained according to various methods. Eqs. (6) and (7) using empirical constants a1, b1, a2, and b2 show examples obtained by digitizing these methods.

$$h = A \times a1 + b1 \quad \text{Eq. (6)}$$

$$h = \frac{a2}{A} + b2 \quad \text{Eq. (7)}$$

The height h of the object obtained by the foregoing equations is a measurement value for the case when the object passes immediately under the light source 100, so in other cases $COS^2$ A may be multiplied as in Eq. (3) to establish Eq. (8) as follows:

$$h' = h \times COS^2 A \quad \text{Eq. (8)}$$

Meanwhile, as shown in Eq. (4), the weighted sum may be obtained only for some sensors 211 over which the shadow passes, rather than obtaining the weighted sum for all of the sensors 211 over which the shadow passes. In this case, the following equation may be used.

$$S1 = \sum_{i \in Z} s_i \times t_i \quad \text{Eq. (9)}$$

wherein the set Z refers to a set comprised of the indexes of the sensors 211 to be calculated.

Eq. (9) can be applied to the following case. For example, in a virtual golf system, when the shadow of a golf ball overlaps with a shadow of a different component (e.g., the golf club), a process of separating the shadow of the golf ball and that of the different component may be preferentially performed. By clearly separating the shadow of the golf ball and that of the different component, only the indexes of the sensors 211 corresponding to the shadow of the golf ball can be included in the set Z.

$$S2 = S1 \times U(Z) \quad \text{Eq. (10)}$$

wherein U(Z) refers to a correction coefficient in case of using only the sensors 211 whose indexes belong to the set Z. For example, when Z includes only indexes of half of the sensors 211 over which the shadow of the object passes, the correction coefficient U(Z) may be 2. The calculated S2 may be used, instead of S, in the foregoing Eqs. (5) to (8).

Meanwhile, Eq. (10) relates to application of a certain correction coefficient through multiplication, but of course, various linear and nonlinear equations may be derived depending on applications of a skilled person in the art.

Figure 8:
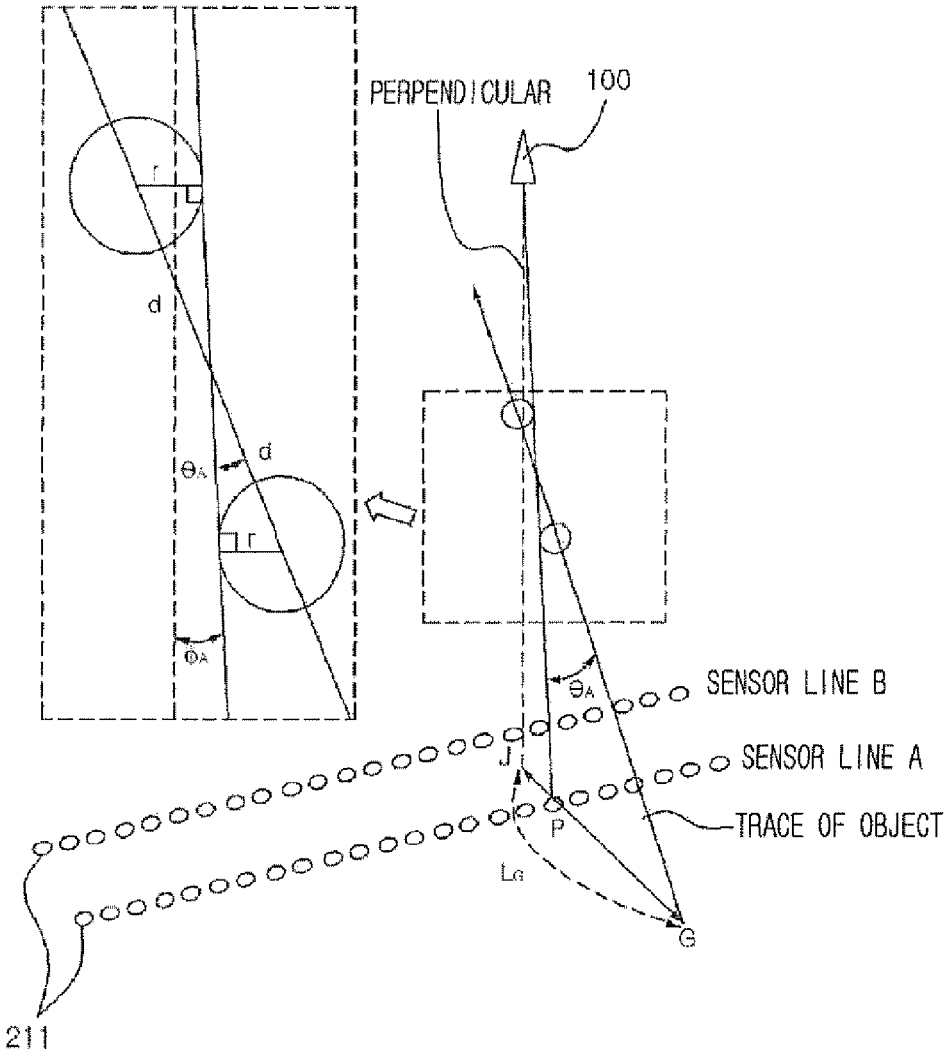
FIG. 8 is a conceptual view regarding an idea of measuring the height of an object based on a duration in which the shadow passes over sensors and an angle between a straight line connecting a light source and the sensors and a trace of the object, according to an embodiment of the present invention.

(3) Idea of measuring the height of an object based on a duration in which a shadow passes over sensors and an angle between a straight line connecting a light source and sensors and a trace of the object FIG. 8 is a conceptual view regarding an idea of measuring the height of an object based on a duration in which the shadow passes through sensors and an angle between a straight line connecting a light source and sensors and a trace of the object, according to an embodiment of the present invention.

First, referring to points and variables illustrated in FIG. 8, G is a point from which the object starts to move, J is a foot of a perpendicular down to the bottom surface from the light source 100, P is a location of the sensor 211 when the shadow of the object passes on the sensor line A, $\theta_A$ is an angle between a straight line connecting the light source 100 and P and an actual trace of the object, $\Phi_A$ is an angle between a straight line connecting the light source 100 and P and the perpendicular between the light source 100 and the bottom surface, d is a half of the distance along which the object moves while throwing a shadow to the sensor 211, r is a radius of the spherical object, $L_G$ is the distance between J and G, and $L_{AB}$ is the distance between the sensor line A and the sensor line B.

A duration in which the moving object throws a shadow to the sensor line A may be expressed by time $t_A$ during which the object moves by the distance 2*d*. The time $t_A$ may satisfy $t_A$=2 d/v assuming that the movement speed v of the object is constant. Here, d=r/sin $\theta_A$. Thus, $t_A$ may be finally expressed by the following Eq. (11):

$$t_A = \frac{2r}{(v \times \sin\theta_A)} \quad \text{Eq. (11)}$$

And then, if a duration in which the object passes between the sensor line A and the sensor line B is $t_{AB}$, then $t_{AB}=L_{AB}/V_x$.

Here, $v_x$ is a magnitude of a component of the movement speed v of the object which is parallel to the bottom surface.

Then, the angle $\theta_A$ may be obtained by the following Eq. (12):

$$\theta_A = \cot^{-1} \frac{\left(\left(\frac{t_A}{t_{AB}}\right) \times \left(\frac{L_{AB}}{2r}\right) - \cos\Phi_A\right)}{(\sin\Phi_A)} \quad \text{Eq. (12)}$$

Thus, the height $h_A$ of the object as the shadow of the object passes over the sensor line A may be expressed by Eq. (13):

$$h_A = L_G \times \cot(\theta_A + \Phi_A) \quad \text{Eq. (13)}$$

Here, it may be preferred to use the distance between G and the foot of the perpendicular down to the bottom surface from the object as the shadow of the object passes over the sensor line A, instead of $L_G$.

The angle $\theta_B$ and the height $h_B$ of the object regarding the sensor line B may be expressed by Eqs. (14) and (15) shown below according to the same principles.

$$\theta_B = \cot^{-1} \frac{\left(\left(\frac{t_B}{t_{AB}}\right) \times \left(\frac{L_{AB}}{2r}\right) - \cos\Phi_B\right)}{(\sin\Phi_B)} \quad \text{Eq. (14)}$$

$$h_B = L_G \times \cot(\theta_B + \Phi_B) \quad \text{Eq. (15)}$$

The embodiments according to present invention as described above can be implemented in the form of program instructions that can be executed by various computer components and recorded in a computer in a computer-readable recording medium. The computer-readable recording medium may include program instructions, data files, data structures, and the like alone or in combination. The program instructions recorded in the computer-readable recording medium may be specially designed and configured for the present invention or known and usable to a person skilled in the field of computer software. Examples of the computer-readable recording medium include a magnetic medium such as a hard disk, a floppy disk, or a magnetic tape, an optical recording medium such as a CD-ROM or a DVD, a magneto-optical medium such as a floptical disk, and a hardware device specially configured to store and execute program instructions such as a ROM, a RAM, a flash memory, or the like. Examples of the program instructions include machine codes that are produced by a compiler as well as high level language codes that can be executed by a computer using an interpreter or the like. The hardware device may be configured to operate as one or more software modules in order to perform the processes according to the present invention, and vice versa.

According to the present invention, it is possible to precisely measure a physical quantity of an object by using only a single light source and a planar sensor unit.

Also, according to the present invention, it is possible to implement a virtual golf system effectively operated at a low cost.

While the invention has been shown and described with respect to the particular embodiments, it will be understood by those skilled in the art that various changes and modification may be made without departing from the spirit and scope of the invention as defined in the following claims.

What is claimed is:

1. A method for measuring a physical quantity of an object by using a single light source and a planar sensor unit, the method comprising:

detecting, by the planar sensor unit, a shadow of the object generated by light emitted from the single light source, wherein the planar sensor unit is disposed on a bottom surface opposed to the single light source; and measuring a height of the object based on a size of the shadow when the object passes between the single light source and the planar sensor unit, wherein the height is a distance between the object and the bottom surface, wherein the planar sensor unit includes a plurality of sensors, and wherein measuring the height of the object is performed based on an estimate value of the size of the shadow calculated by dividing a weighted sum of durations in which the shadow passes over each of the plurality of sensors and the output of the corresponding sensor in the duration by a duration in which the shadow passes over the plurality of sensors.

2. The method of claim 1, wherein the single light source has excellent straightness of light.

3. The method of claim 1, wherein at least some of the plurality of sensors form a plurality of sensor lines.

4. The method of claim 3, wherein, in case the number of the plurality of sensor lines is n, the distance $h_n$ between adjacent sensor lines is expressed by the following equation:

$$h_n = \frac{\sqrt{n^2 - 1}}{n} \times d$$

wherein d is a unit space between the sensors belonging to the plurality of sensor lines.

5. The method of claim 1, wherein detecting the shadow comprises detecting an error of at least one sensor belonging to the plurality of sensors.

6. The method of claim 5, wherein detecting the error comprises detecting whether or not the reference sensor voltage of the at least one sensor is higher than a minimum allowable voltage and lower than a maximum allowable voltage.

7. The method of claim 5, wherein detecting the error comprises detecting whether or not a deviation of the reference sensor voltage of the at least one sensor is smaller than an allowable voltage deviation.

8. The method of claim 5, wherein detecting the shadow further comprises correcting an error of the at least one sensor.

9. The method of claim 8, wherein correcting the error comprises determining a common output value of the sensors at both sides of the at least one sensor as an output value of the at least one sensor.

10. The method of claim 8, wherein correcting the error comprises maintaining a previous output value of the at least one sensor in case output values of the sensors at both sides of the at least one sensor are different from each other.

11. A system for measuring a physical quantity of an object, the system comprising:

a single light source;

a planar sensor unit for detecting a shadow of the object generated by light emitted from the single light source, wherein the planar sensor unit is disposed on a bottom surface opposed to the single light source; and a measurement device for measuring a height of the object based on a size of the shadow when the object passes between the single light source and the planar sensor unit, wherein the height is a distance between the object and the bottom surface, wherein the planar sensor unit includes a plurality of sensors, and wherein the measurement device measures the height of the object based on an estimate value of the size of the shadow calculated by dividing a weighted sum of durations in which the shadow passes over each of the plurality of sensors and the output of the corresponding sensor in the duration by a duration in which the shadow passes over the plurality of sensors.

12. The system of claim 11, wherein at least some of the plurality of sensors form a plurality of sensor lines.

* * * * *